US006295993B1

(12) United States Patent
Ouellette

(10) Patent No.: US 6,295,993 B1
(45) Date of Patent: Oct. 2, 2001

(54) METHOD AND APPARATUS FOR HIGHLIGHTING HAIR

(76) Inventor: Marc Ouellette, 4572 Maple Lane, Inverary ON (CA), K0H 1X0

( * ) Notice: Subject to any disclaimer, the term of this patent is extended or adjusted under 35 U.S.C. 154(b) by 0 days.

(21) Appl. No.: 09/772,314

(22) Filed: Jan. 26, 2001

(51) Int. Cl.[7] ..... A61K 7/13; A45D 19/18
(52) U.S. Cl. ..... 132/208; 132/270
(58) Field of Search ..... 606/210, 211; 132/208, 270

(56) References Cited

U.S. PATENT DOCUMENTS

| | | | |
|---|---|---|---|
| 1,426,373 | | 8/1922 | Frederics . |
| 1,550,930 | | 8/1925 | Sullivan . |
| 2,655,924 | | 10/1953 | Petita . |
| 2,819,721 | | 1/1958 | Zakon . |
| 3,101,724 | | 8/1963 | Nizetich . |
| 3,640,289 | | 2/1972 | Sbarra . |
| 3,729,289 | | 4/1973 | Bouvier . |
| 3,805,810 | | 4/1974 | Savala . |
| 4,155,369 | | 5/1979 | Guinan . |
| 4,165,754 | | 8/1979 | Di Pasqua . |
| 4,658,840 | | 4/1987 | McCosker . |
| 4,727,893 | | 3/1988 | Concalves . |
| 4,760,855 | | 8/1988 | DiLorenzo . |
| 4,961,439 | * | 10/1990 | Artmann ..... 132/270 |
| 5,042,514 | | 8/1991 | Bastien . |
| 5,304,183 | * | 4/1994 | Gourlay et al. ..... 604/211 |
| 5,584,309 | | 12/1996 | De Benedictus . |
| 5,771,906 | | 6/1998 | De Benedictus . |

* cited by examiner

*Primary Examiner*—Todd E. Manahan
(74) *Attorney, Agent, or Firm*—Richard J. Hicks

(57) ABSTRACT

A method and apparatus for highlighting hair is described. A frame, having a pair of parallel rods and a scalp engaging member mounted therebetween at the lower end, has a guide tube mounted parallel to the rods adjacent the upper end thereof, and a spring loaded plunger having a double prong at the lower end is mounted through the guide tube and concentric therewith. A treatment tube, usually made of aluminum foil, is placed over the guide tube and the apparatus is placed against the scalp. The spring-loaded plunger is operated to extend the prongs, which encircle selected strands of hair, and then released to draw the hair into the guide tube. The apparatus is then removed from the scalp and the treatment tube is pushed off the guide tube so as to contain the selected strands of hair within it. The lower end is then crimped around the hair, treatment solution is added and the top is crimped. After a selected treatment time the treatment tube is removed.

8 Claims, 3 Drawing Sheets

METHOD AND APPARATUS FOR HIGHLIGHTING HAIR

FIELD OF INVENTION

This invention relates to a method and apparatus for treating hair. More particularly, this invention relates to methods and apparatus for selectively colouring selected strands of hair on the scalp.

BACKGROUND OF INVENTION

The colouration or highlighting of selected strands of hair has been practised for many years and numerous methods for achieving the desired effect have been published in the patent and trade literature. Generally, there are three methods for highlighting hair, known in the trade as "capping", "combing" and "foiling". In capping, the subject's hair is covered with a thin rubber cap having a multiplicity of small holes therethrough. A hooking device is then used to pull selected strands of hair through the cap and colour or bleach is then applied to the hair strands. This procedure has numerous disadvantages because the operator cannot see the hair to be selected through the rubber cap, and cannot accurately select the optimum number of hairs to be treated. It can also be extremely painful if the steel hook is inadvertently jabbed into the scalp. It is also difficult to pick all of the hair up at the root with the result that some is selected at midshaft resulting in unsatisfactory overall colouring. It is difficult to apply the colour close to the hair roots and it is also difficult to apply more than one colour. It is also difficult to remove the cap from the head after treatment and often requires a tedious cutting procedure. Attention is directed to U.S. Pat. No. 4,165,754 issued Aug. 28, 1979 and U.S. Pat. No. 4,155,369 issued May 22, 1979, as examples of the cap method.

The combing method involves a comb, which is dipped into the treating liquid, and then pulled through the hair to be treated. Only relatively large swatches of hair can be treated in this manner and it is difficult to avoid bleeding of the treating liquid to those parts of the head that are not to be treated.

The foil method, which is widely used in the salon market, requires the operator to select the appropriate number of swatches and to wrap each swatch in a flexible, chemically impervious foil generally, but not essentially, an aluminum foil so as to form a packet around the swatch. Once the foil is in place the treating solution is introduced into the packet and the ends thereof are crimped so as to retain the solution in close contact with the hair. As it is usual to treat some fifty to seventy swatches in this manner, it takes considerable manual dexterity on the part of the stylist and more than 45 minutes to completely prepare a head of hair. As the treatment solutions usually require from 10 to about 45 minutes to be effective, this causes considerable problems. It will be appreciated that the first hair to be treated will be completely finished before the last hair to be treated has been processed at all. Stylists try to compensate for this by using different strength solutions as the wrapping process continues or by applying heat to the later treated hair to speed up the process. The result is frequently uneven colouring over the head if not actual damage to the hair. Because of the high degree of skill required to produce satisfactory results, the foiling method is not suitable for home use. Several attempts to improve upon the basic foiling method have been described in the literature and attention is directed to U.S. Pat. Nos. 5,042,514; 2,819,721 and 2,655,924 which all describe methods and apparatus for colouring selected swatches of hair using prefabricated sleeves or tubes into which the hair is drawn for treatment using a transverse hook or jaws to grip and guide the hair. The treating solution is then poured into the tube which is then clamped shut for the appropriate treating time. While an improvement over previous methods in that more hair can be treated more quickly, the tubes are difficult to handle and it is difficult to control how much hair is drawn into the tube and the hair is frequently grasped in midshaft, making it difficult to treat the roots and sometimes impossible to draw the entire swatch into the tube, especially if the hair is rather long. Because the hair is actually gripped by the jaws, adjustments are not readily made without painful pulling of the hair. There is, therefore a need for an improved method and apparatus for highlighting hair that is suitable for both home and salon use which can be used on very small swatches of hair, which can treat hair very close to the roots and which can be used to retouch previously treated hair.

OBJECT OF INVENTION

It is an object of the present invention to provide an apparatus for rapidly bringing selected strands of hair, extending from a scalp, into a treatment tube into which a treatment solution can be introduced. The treatment tube is slidably mounted on the apparatus so that the distal end thereof can be brought into close contact with the scalp.

It is another object of this invention to provide a method of highlighting selected strands of hair extending from a scalp, which is suitable for both home and salon use.

SUMMARY OF INVENTION

By one aspect of this invention there is provided an apparatus comprising (a) a frame having a pair of parallel rods, each having a proximal and a distal end, a curved scalp contacting member interconnecting the distal ends of said rods, and guide tube means mounted in parallel relationship between said parallel rods from a position adjacent said proximal ends thereof; and (b) spring loaded plunger means coaxially mounted through said guide tube means, comprising handle means at a proximal end thereof adjacent said proximal ends of said parallel rods, a pair of curved prongs at a distal end thereof, connected to said handle means through a guide means, adapted to move between an open position and a closed position forming a loop, and spring means intermediate said proximal and distal ends normally urging said prongs towards said closed position By another aspect of this invention there is provided a method for treating selected strands of hair extending from a scalp comprising providing an apparatus comprising a frame having a pair of parallel rods, each having a proximal and a distal end, a curved scalp contacting member interconnecting the distal ends of said rods, and guide tube means mounted in parallel relationship between said parallel rods from a position adjacent said proximal ends thereof; spring loaded plunger means coaxially mounted through said guide tube means, comprising handle means at a proximal end thereof adjacent said proximal ends of said parallel rods, a pair of curved prongs at a distal end thereof, connected to said handle means through a guide means, adapted to move between an open position and a closed position forming a loop, and spring means intermediate said proximal and distal ends normally urging said prongs towards said closed position slidably mounting a treatment tube over said guide tube means; placing said scalp contacting member in contact with said scalp; selecting hairs to be treated; operating said handle means so as to extend said prongs to said open position adjacent said selected hairs; closing said prongs around said selected hairs and drawing said hairs into said guide tube means; withdrawing said frame from said scalp and slidably removing said treatment tube from said guide tube means so as to encircle said selected hairs; crushing a distal end of said treatment tube about said selected hairs adjacent the proximal ends thereof so as to provide a liquid impermeable seal therebetween; filling said treatment tube with a selected hair treating agent; closing a proximal end of said treatment tube about said selected hairs adjacent the distal ends thereof; and, after a selected treatment time, removing said treatment tube from said selected hairs.

By yet another aspect of this invention there is provided a kit, suitable for home use, for treating selected hairs extending from a scalp with a hair treating agent comprising: (a) a frame having a pair of parallel rods, each having a proximal and a distal end, a curved scalp contacting member interconnecting the distal ends of said rods, and guide tube means mounted in parallel relationship between said parallel rods from a position adjacent said proximal ends thereof; and (b) spring loaded plunger means coaxially mounted through said guide tube means, comprising handle means at a proximal end thereof adjacent said proximal ends of said parallel rods, a pair of curved prongs at a distal end thereof, connected to said handle means through a guide means, adapted to move between an open position and a closed position forming a loop, and spring means intermediate said proximal and distal ends normally urging said prongs towards said closed position; and at least one of: (c) a plurality of treatment tubes slidably mountable on said guide tube means and (d) a supply of a selected said hair treating agent.

DETAILED DESCRIPTION OF PREFERRED EMBODIMENTS

Figure 1:
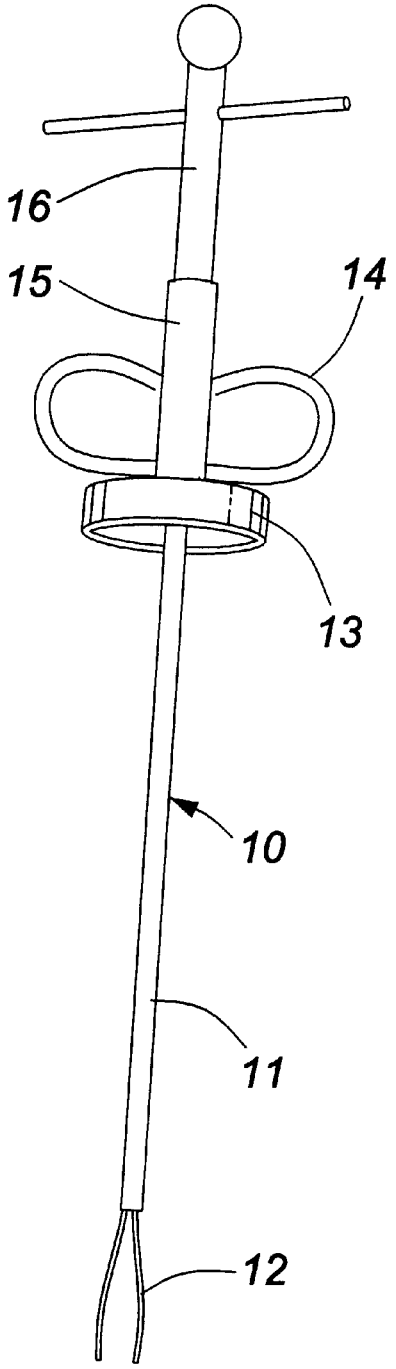
FIG. 1 is a side view of a positioning frame according to one embodiment of the present invention.
Figure 2:
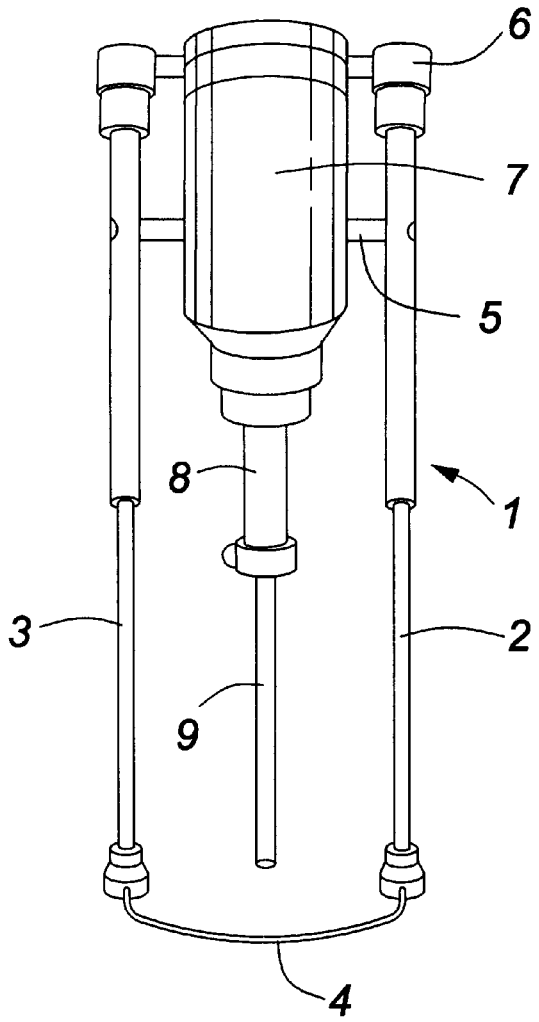
FIG. 2 is a side view of a spring loaded prong device for use in the frame of FIG. 1.
Figure 4:
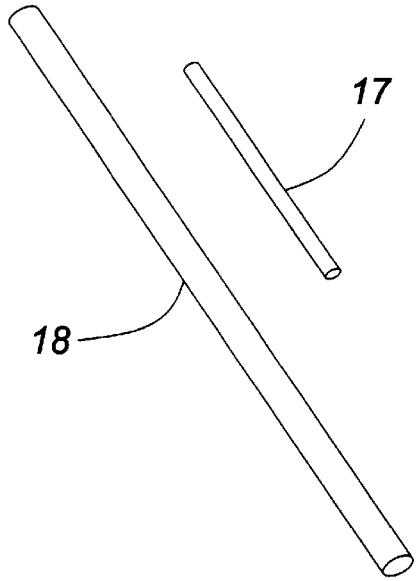
FIG. 4 is a perspective view of tubes used in conjunction with the device of FIG. 3.
Figure 3:
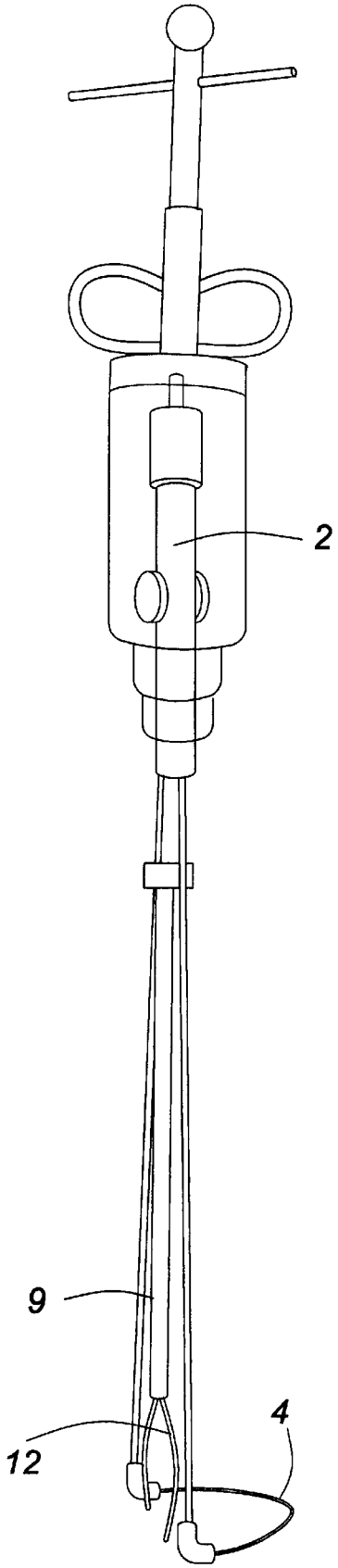
FIG. 3 is a side view of the frame of FIG. 1 and the prong device of FIG. 2 in assembled position.

In FIG. 1 there is shown a frame 1, comprising a pair of parallel, preferably but not essentially telescopic, rods 2,3 interconnected at the distal ends thereof by a curved, scalp engaging, member 4, and at the proximal ends thereof by transverse members 5,6. Optionally, a treating fluid container 7 having a downwardly directed, in operative position, elongated delivery spout at the distal end thereof in parallel relationship to rods 2,3, is mounted on members 5,6 and connected to a substantially rigid hollow guide tube 9. It will be appreciated that in an alternative embodiment the container 7 may be eliminated and tube 9 mounted directly to transverse member 5,6. In FIG. 2 there is shown a spring loaded gripper having an outer tube 11, containing a two prong gripper 12 extending therefrom, mounted on a cap 13 adapted to be releasably connected to container 7 at the proximal end thereof. Cap 13 is provided with finger grips 14 and a concentric housing 15 for the spring (not shown). A plunger 16 is slidably mounted through housing 15 so as to operate the prongs 12 in conventional manner. The assembled device is shown in FIG. 3. with the rods 2,3 shown in extended position. FIG. 4 shows two tubes 17, 18, prefabricated from a planar, flexible and liquid impermeable material generally, but not essentially, of aluminum foil, of different lengths. Tubes 17, 18 are adapted to slide over the distal end of guide tube 9 into overlying coaxial relationship therewith.

Figure 5:
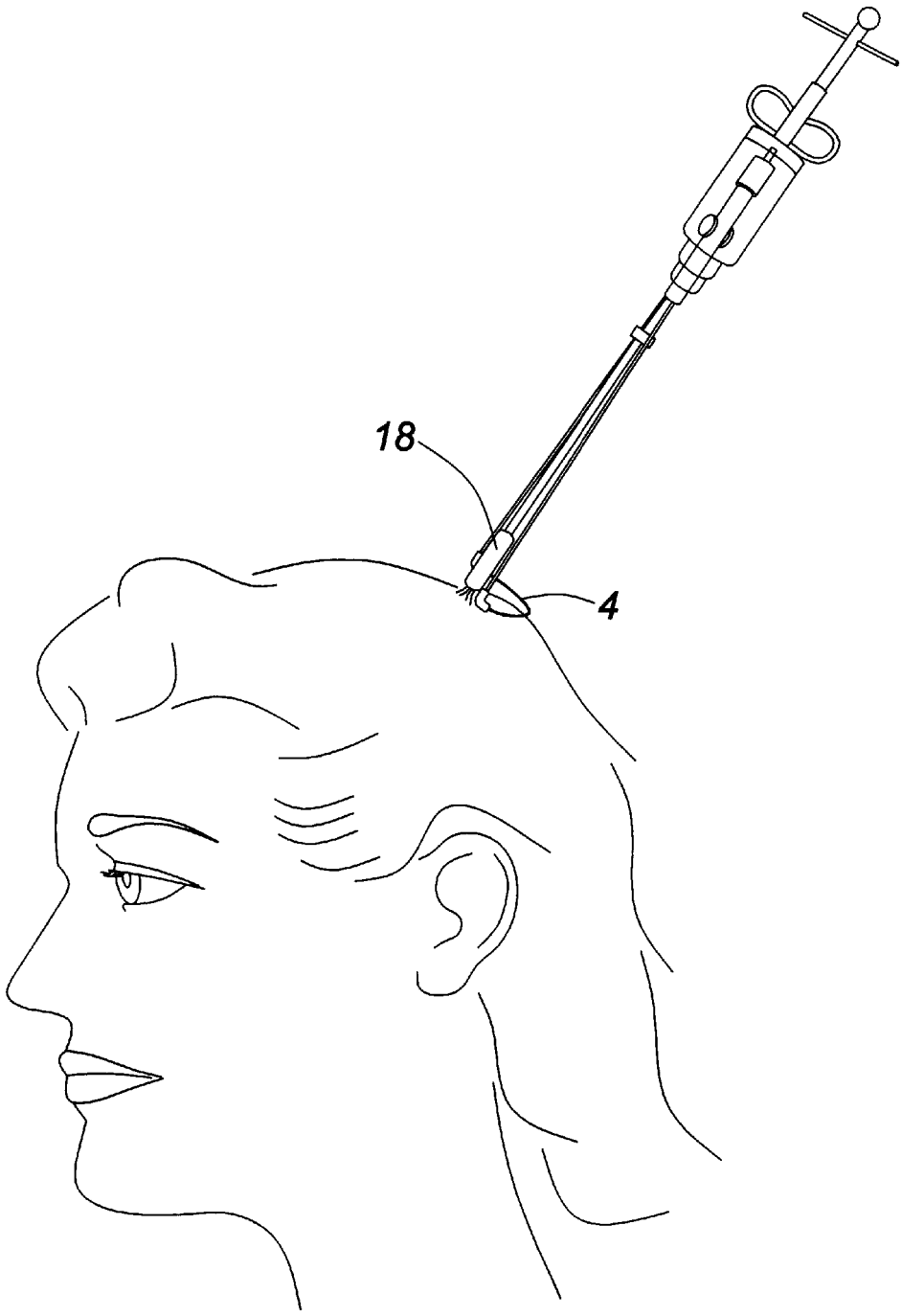
FIG. 5 is a perspective view of the apparatus of the present invention in operative position on a scalp.

In operation, a tube 17 or 18 of selected length, depending upon the length of hair to be treated is slid over tube 9 and prongs 12 are extended by downward pressure on handle 16. The frame 1 is then placed on the scalp to be treated, as seen in FIG. 5, with member 4 in close contact therewith. The prongs 12, which open to a diameter somewhat larger than the diameter of tube 9, encircle the selected number of hairs, which may vary from very few to fifty or more, by releasing the pressure on handle 16 and then drawn into tube 9. It has been found that providing telescopic rods 2,3 facilitates holding tube 9 in close contact with the scalp as the prongs retract before fully closing, thus ensuring that all of the selected hairs remain in the ring or loop formed by the closed prongs. It will be appreciated that prongs 12 encircle the hair, which is generally flat against the scalp, forming a loop therearound and slide up the hair from the proximal ends thereof towards the distal ends thereof thus pulling the hair longitudinally upwardly into the tube 9. The tube 17 is then pushed off tube 9, and into close contact with the scalp, and the distal end of the hairs pass through the loop formed by the prongs 12 and thus, released into the tube 17. The distal end of tube 17, in close proximity to the scalp is then pinched tightly so as to form a liquid tight seal around the swatch of hair inside. Treating liquid can then be dispensed from container 7 and the proximal end of the tube pinched closed. The apparatus is then moved to the next selected location and the operation repeated. It will be appreciated that the apparatus can easily be manipulated with one hand and the second hand can then be used to slide the tube 17 off tube 9. Positioning is simple and facilitated by the frame 1 which acts as a rest. A skilled operator can readily place over 100 tubes in less than 10 minutes. If the container 7 is not employed, when all of the tubes have been placed they can be filed with treating liquid from an external supply (not shown), and the proximal ends pinched closed. As the operation is so quick, application times for the individual swatches are much more uniform, with the result that the treated hair is more uniformly coloured. As the level of skill required to perform the application is relatively low, this method and apparatus is suitable for home use, and the provision of home treatment kits, comprising the apparatus as described hereinabove together with a supply of treatment tubes and/or a suitably packaged supply of selected hair treating agents such as bleaching agents, colouring agents and highlighting agents is contemplated within the scope of this invention.

What is claimed is:

1. An apparatus for applying a hair-treating agent to selected strands of hair extending from a scalp, comprising: (a) a frame having a pair of parallel rods, each having a proximal and a distal end, a curved scalp contacting member interconnecting the distal ends of said rods, and guide tube means mounted in parallel relationship between said parallel rods from a position adjacent said proximal ends thereof; and (b) spring loaded plunger means coaxially mounted through said guide tube means, comprising handle means at a proximal end thereof adjacent said proximal ends of said parallel rods, a pair of curved prongs at a distal end thereof, connected to said handle means through a guide means, adapted to move between an open position and a closed position forming a loop, and spring means intermediate said proximal and distal ends normally urging said prongs towards said closed position.

2. An apparatus as claimed in claim 1 including a crushable, liquid impermeable treatment tube adapted for slidable coaxial mounting on said guide tube means.

3. An apparatus as claimed in claim 2 wherein said treatment tube is an aluminum tube.

4. An apparatus as claimed in claim 1, including a hair treating agent container mounted on said frame and to said guide tube means.

5. An apparatus as claimed in claim 1 wherein said parallel rods are telescopic rods.

6. A method of applying a hair treatment agent to selected strands of hair extending from a scalp, comprising: providing an apparatus having a frame having a pair of parallel rods, each having a proximal and a distal end, a curved scalp contacting member interconnecting the distal ends of said rods, and guide tube means mounted in parallel relationship between said parallel rods from a position adjacent said proximal ends thereof; and spring loaded plunger means coaxially mounted through said guide tube means, comprising handle means at a proximal end thereof adjacent said proximal ends of said parallel rods, a pair of curved prongs at a distal end thereof, connected to said handle means through a guide means, adapted to move between an open position and a closed position forming a loop, and spring means intermediate said proximal and distal ends normally urging said prongs towards said closed position; slidably mounting a treatment tube over said guide tube means; placing said scalp contacting member in contact with said scalp; selecting hairs to be treated; operating said handle means so as to extend said prongs to said open position adjacent said selected hairs; closing said prongs around said selected hairs and drawing said hairs into said guide tube means; withdrawing said frame from said scalp and slidably removing said treatment tube from said guide tube means so as to encircle said selected hairs; crushing a distal end of said treatment tube about said selected hairs adjacent the proximal ends thereof so as to provide a liquid impermeable seal therebetween; filling said treatment tube with a selected hair treating agent; closing a proximal end of said treatment tube about said selected hairs adjacent the distal ends thereof; and, after a selected treatment time, removing said treatment tube from said selected hairs.

7. A kit, suitable for home use, for applying a hair treating agent to selected strands of hair extending from a scalp, comprising: (a) a frame having a pair of parallel rods, each having a proximal and a distal end, a curved scalp contacting member interconnecting the distal ends of said rods, and guide tube means mounted in parallel relationship between said parallel rods from a position adjacent said proximal ends thereof; (b) spring loaded plunger means coaxially mounted through said guide tube means, comprising handle means at a proximal end thereof adjacent said proximal ends of said parallel rods, a pair of curved prongs at a distal end thereof, connected to said handle means through a guide means, adapted to move between an open position and a closed position forming a loop, and spring means intermediate said proximal and distal ends normally urging said prongs towards said closed position; and at least one of: (c) a supply of treatment tubes slidably mountable on said guide tube means and (d) a supply of selected said hair treating agent.

8. A kit as claimed in claim 7, wherein said hair treating agent is selected from the group consisting of a bleaching agent, a colouring agent and a highlighting agent.

* * * * *